US010264375B2

(12) United States Patent
Wacquant et al.

(10) Patent No.: US 10,264,375 B2
(45) Date of Patent: Apr. 16, 2019

(54) VEHICLE SOUND PROCESSING SYSTEM

(71) Applicant: MAGNA ELECTRONICS INC., Auburn Hills, MI (US)

(72) Inventors: Sylvie Wacquant, Mainhausen (DE); Michael Biemer, Aschaffenburg-Obernau (DE)

(73) Assignee: MAGNA ELECTRONICS INC., Auburn Hills, MI (US)

( * ) Notice: Subject to any disclaimer, the term of this patent is extended or adjusted under 35 U.S.C. 154(b) by 0 days.

(21) Appl. No.: 15/790,175

(22) Filed: Oct. 23, 2017

(65) Prior Publication Data

US 2018/0077506 A1 Mar. 15, 2018

Related U.S. Application Data

(63) Continuation of application No. 14/807,011, filed on Jul. 23, 2015, now Pat. No. 9,800,983.
(Continued)

(51) Int. Cl.
*H04R 27/00* (2006.01)
*H04R 3/00* (2006.01)
(Continued)

(52) U.S. Cl.
CPC ..... *H04R 27/00* (2013.01); *H04R 3/005* (2013.01); *G10K 11/346* (2013.01);
(Continued)

(58) Field of Classification Search
None
See application file for complete search history.

(56) References Cited

U.S. PATENT DOCUMENTS 4,930,742 A 6/1990 Schofield et al.
4,956,866 A 9/1990 Bernstein et al.
(Continued)

FOREIGN PATENT DOCUMENTS

WO WO1998017046 4/1998
WO WO1999031637 6/1999
(Continued)

OTHER PUBLICATIONS

Bendler et al., "Emergency Vehicle Detector," ECE4007 Senior Design Project, EMV Detection, Sep. 15, 2008.
(Continued)

*Primary Examiner* — Paul W Huber
(74) *Attorney, Agent, or Firm* — Honigman LLP

(57) ABSTRACT

A sound system for a vehicle includes a plurality of microphones to detect sounds emanating from outside of the vehicle. A sound processor is operable to process microphone output signals of the microphones to identify a source of at least some sounds detected by the microphones. The sound processor processes microphone output signals to identify a sound of interest outside of the vehicle, which includes at least one of (i) a siren of an emergency vehicle and (ii) a horn of another vehicle. Responsive to identification by the sound processor of the sound of interest, a plurality of speakers disposed in the cabin of the vehicle generate sound representative of the identified sound of interest. While the speakers are generating sound representative of the identified sound of interest, sounds generated by the speakers based on audio signals from other sound systems in the vehicle are diminished.

20 Claims, 14 Drawing Sheets

Related U.S. Application Data

(60) Provisional application No. 62/028,497, filed on Jul. 24, 2014.

(51) Int. Cl.

| | |
|---|---|
| *G10L 21/0208* | (2013.01) |
| *G10L 21/0216* | (2013.01) |
| *H04R 3/12* | (2006.01) |
| *H04S 7/00* | (2006.01) |
| *G10K 11/34* | (2006.01) |

(52) U.S. Cl.

CPC .. *G10K 2210/1282* (2013.01); *G10L 21/0208* (2013.01); *G10L 2021/02087* (2013.01); *G10L 2021/02166* (2013.01); *H04R 3/12* (2013.01); *H04R 2227/009* (2013.01); *H04R 2420/03* (2013.01); *H04R 2499/13* (2013.01); *H04S 7/302* (2013.01)

(56) References Cited

U.S. PATENT DOCUMENTS

| | | | |
|---|---|---|---|
| 4,959,865 | A | 9/1990 | Stettiner et al. |
| 4,975,966 | A | 12/1990 | Sapiejewski |
| 5,329,593 | A | 7/1994 | Lazzeroni et al. |
| 5,495,242 | A | 2/1996 | Kick et al. |
| 5,671,996 | A | 9/1997 | Bos et al. |
| 5,703,957 | A | 12/1997 | McAteer |
| 5,820,245 | A | 10/1998 | Desmond et al. |
| 5,828,012 | A | 10/1998 | Repollé et al. |
| 5,850,016 | A | 12/1998 | Jung et al. |
| 5,877,897 | A | 3/1999 | Schofield et al. |
| 5,878,147 | A | 3/1999 | Killion et al. |
| 5,894,279 | A | 4/1999 | Rose et al. |
| 5,979,586 | A | 11/1999 | Farmer |
| 6,166,625 | A | 12/2000 | Teowee et al. |
| 6,243,003 | B1 | 6/2001 | DeLine et al. |
| 6,278,377 | B1 | 8/2001 | DeLine et al. |
| 6,326,613 | B1 | 12/2001 | Heslin et al. |
| 6,329,925 | B1 | 12/2001 | Skiver et al. |
| 6,362,749 | B1 | 3/2002 | Brill |
| 6,363,156 | B1 | 3/2002 | Roddy |
| 6,366,213 | B2 | 4/2002 | DeLine et al. |
| 6,420,975 | B1 | 7/2002 | DeLine et al. |
| 6,428,172 | B1 | 8/2002 | Hutzel et al. |
| 6,433,676 | B2 | 8/2002 | DeLine et al. |
| 6,485,081 | B1 | 11/2002 | Bingle et al. |
| 6,501,387 | B2 | 12/2002 | Skiver et al. |
| 6,614,911 | B1 | 9/2003 | Watson et al. |
| 6,648,477 | B2 | 11/2003 | Hutzel et al. |
| 6,690,268 | B2 | 2/2004 | Schofield et al. |
| 6,717,524 | B2 | 4/2004 | DeLine et al. |
| 6,774,356 | B2 | 8/2004 | Heslin et al. |
| 6,798,890 | B2 | 9/2004 | Killion et al. |
| 6,882,734 | B2 | 4/2005 | Watson et al. |
| 6,906,632 | B2 | 6/2005 | DeLine et al. |
| 6,980,092 | B2 | 12/2005 | Turnbull et al. |
| 6,980,663 | B1 | 12/2005 | Linhard |
| 7,038,577 | B2 | 5/2006 | Pawlicki et al. |
| 7,061,402 | B1 | 6/2006 | Lawson |
| 7,245,232 | B1 | 7/2007 | Caouette, Sr. |
| 7,308,341 | B2 | 12/2007 | Schofield |
| 7,415,116 | B1 | 8/2008 | Fels |
| 7,657,052 | B2 | 2/2010 | Larson et al. |
| 7,720,580 | B2 | 5/2010 | Higgins-Luthman |
| 7,791,499 | B2 | 9/2010 | Mohan et al. |
| 7,855,755 | B2 | 12/2010 | Weller et al. |
| 8,094,040 | B1 | 1/2012 | Cornett et al. |
| 8,258,932 | B2 | 9/2012 | Wahlstrom |
| 8,275,145 | B2 | 9/2012 | Buck |
| 8,319,620 | B2 | 11/2012 | Usher et al. |
| 8,355,521 | B2 | 1/2013 | Larson et al. |
| 8,824,697 | B2 | 9/2014 | Christoph |
| 9,278,689 | B1 | 3/2016 | Delp |
| 9,397,630 | B2 | 7/2016 | Wang |
| 9,417,838 | B2 | 8/2016 | Baalu et al. |
| 9,576,208 | B2 | 2/2017 | Agnew et al. |
| 9,800,983 | B2 | 10/2017 | Wacquant et al. |
| 2002/0032510 | A1 | 3/2002 | Turnbull et al. |
| 2002/0080021 | A1 | 6/2002 | Skiver et al. |
| 2002/0110255 | A1 | 8/2002 | Killion et al. |
| 2002/0110256 | A1 | 8/2002 | Watson et al. |
| 2004/0170286 | A1 | 9/2004 | Durach |
| 2005/0074131 | A1 | 4/2005 | Mc Call et al. |
| 2006/0023892 | A1 | 2/2006 | Schultz |
| 2012/0121113 | A1* | 5/2012 | Li ..... H04R 1/403 381/302 |
| 2012/0136559 | A1* | 5/2012 | Rothschild ..... G08G 1/0965 701/117 |
| 2012/0230504 | A1 | 9/2012 | Kuroda |
| 2013/0223643 | A1* | 8/2013 | Sato ..... G08B 3/10 381/86 |
| 2015/0137998 | A1 | 5/2015 | Marti |
| 2015/0294169 | A1 | 10/2015 | Zhou et al. |
| 2015/0296135 | A1 | 10/2015 | Wacquant et al. |
| 2016/0355125 | A1 | 12/2016 | Herbert |

FOREIGN PATENT DOCUMENTS

| | | |
|---|---|---|
| WO | WO2001037519 | 5/2001 |
| WO | WO2014204794 | 12/2014 |

OTHER PUBLICATIONS

Fazenda et al., "Acoustic based safety emergency vehicle detection for intelligent transport systems," IEEE ICCAS-SICE, Sep. 2009.

Fragoulis et al., "A Siren Detection System based on Mechanical Resonant Filters," Sensors 2001, vol. 1, pp. 121-137.

Park et al., "Automatic Detection of Emergency Vehicles for Hearing Impaired Drivers", Texas A&M University-Kingsville, EE/CS Department, 2000.

Schröder et al., "Automatic Acoustic Siren Detection in Traffic Noise by Part-Based Models", IEEE International Conference on Acoustics, Speech and Signal Processing (ICASSP), May 2013.

Schwander et al., "Effect of two-microphone noise reduction on speech recognition by normal-hearing listeners" Veterans Administration, Journal of Rehabilitation Research and Development, vol. 24, No. 4, pp. 87-92, Fall 1987.

Simmer et al., "Adaptive Microphone Arrays for Noise Suppression in the Frequency Domain" Second Cost 229 Workshop on Adaptive Algorithms in Communications, Bordeaux, 30.92.10.1992.

Zhang et al., "High-speed Noise Cancellation with Microphone Array" Technology Reports, NTT DoCoMo Technical Journal vol. 9, No. 4.

* cited by examiner

Speaking passenger

Sounding Loudspeaker

Display screen with a passenger's face displayed thereat

VEHICLE SOUND PROCESSING SYSTEM

CROSS REFERENCE TO RELATED APPLICATIONS

The present application is a continuation of U.S. patent application Ser. No. 14/807,011, filed Jul. 23, 2015, now U.S. Pat. No. 9,800,983, which claims the filing benefits of U.S. provisional application Ser. No. 62/028,497, filed Jul. 24, 2014, which is hereby incorporated herein by reference in its entirety.

FIELD OF THE INVENTION

The present invention relates generally to a vehicle sound system for a vehicle and, more particularly, to a vehicle sound system that utilizes multiple microphones in a vehicle.

BACKGROUND OF THE INVENTION

Use of microphones in vehicle sound systems is common and known. Examples of such known systems are described in U.S. Pat. Nos. 7,657,052; 6,420,975; 6,278,377 and 6,243,003, which are hereby incorporated herein by reference in their entireties.

SUMMARY OF THE INVENTION

The present invention provides a sound processing system or voice acquisition system for a vehicle that utilizes multiple microphones to capture or receive sound signals from a person speaking in the vehicle and from other areas inside or outside the vehicle cabin, and that utilizes multiple speakers to generate output signals to enhance the sound heard by other passengers or occupants in the vehicle.

According to an aspect of the present invention, a sound system of a vehicle comprises a plurality of microphones disposed in a cabin of a vehicle and a plurality of speakers disposed in the cabin of the vehicle at or near respective seats of the vehicle. A sound processor is operable to process microphone output signals of the microphones to determine a voice signal of a speaking occupant in the vehicle at or near one of the microphones. The sound processor generates a processor output signal that is provided to at least some of the speakers. Responsive to the processor output signal, some of the speakers generate sound representative of the voice signal of the speaking occupant to direct the sound towards at least some of the other occupants in the vehicle, while one or more speakers at or near the seat occupied by the speaking occupant do not generate sound representative of the voice signal of the speaking occupant so as to not direct the sound towards the speaking occupant.

Optionally, a user input may be actuatable to select two or more occupants of the vehicle for a conversation, with one of the selected occupants being the speaking occupant. Responsive to the processor output signal, speakers at or near the seat occupied by another selected occupant (a non-speaking selected occupant) generate sound representative of the voice signal of the speaking occupant to direct the sound towards the other selected occupant, while speakers at or near a seat occupied by a non-selected occupant (whether that non-selected occupant is speaking or not) do not generate sound representative of the voice signal of the speaking occupant so as to not direct the sound towards the non-selected occupant. The selected occupants may alternate as to who is speaking, with the system generating the processor output signal responsive to the then-speaking selected occupant.

Optionally, a plurality of cameras may be disposed in the vehicle and having respective fields of view towards respective ones of the seats of the vehicle to capture image data representative of a face area of an occupant sitting at the respective seat. One of the cameras captures images of a face of the speaking occupant for display of the speaking occupant's face on one or more video display screens in the vehicle, such as for viewing by the other occupants (or other selected occupants if a selection of particular conversation members has been made).

Optionally, one or more microphones may be disposed exterior of the cabin of the vehicle, and the sound processor may reduce noise in the processor output signal responsive to the exterior microphones. Optionally, the sound processor may be operable to determine a noise of interest from the signals of the exterior microphones, and the sound processor may control the speakers to generate sound representative of the noise of interest at least towards a driver of the equipped vehicle. The noise of interest may comprise at least one of (i) a siren of an emergency vehicle and (ii) a horn of another vehicle. Optionally, the sound processor may control the speakers so that the sound representative of the noise of interest is heard by the driver as if emanating from a direction towards the source of the sound of interest.

These and other objects, advantages, purposes and features of the present invention will become apparent upon review of the following specification in conjunction with the drawings.

DESCRIPTION OF THE PREFERRED EMBODIMENTS

Figure 4:
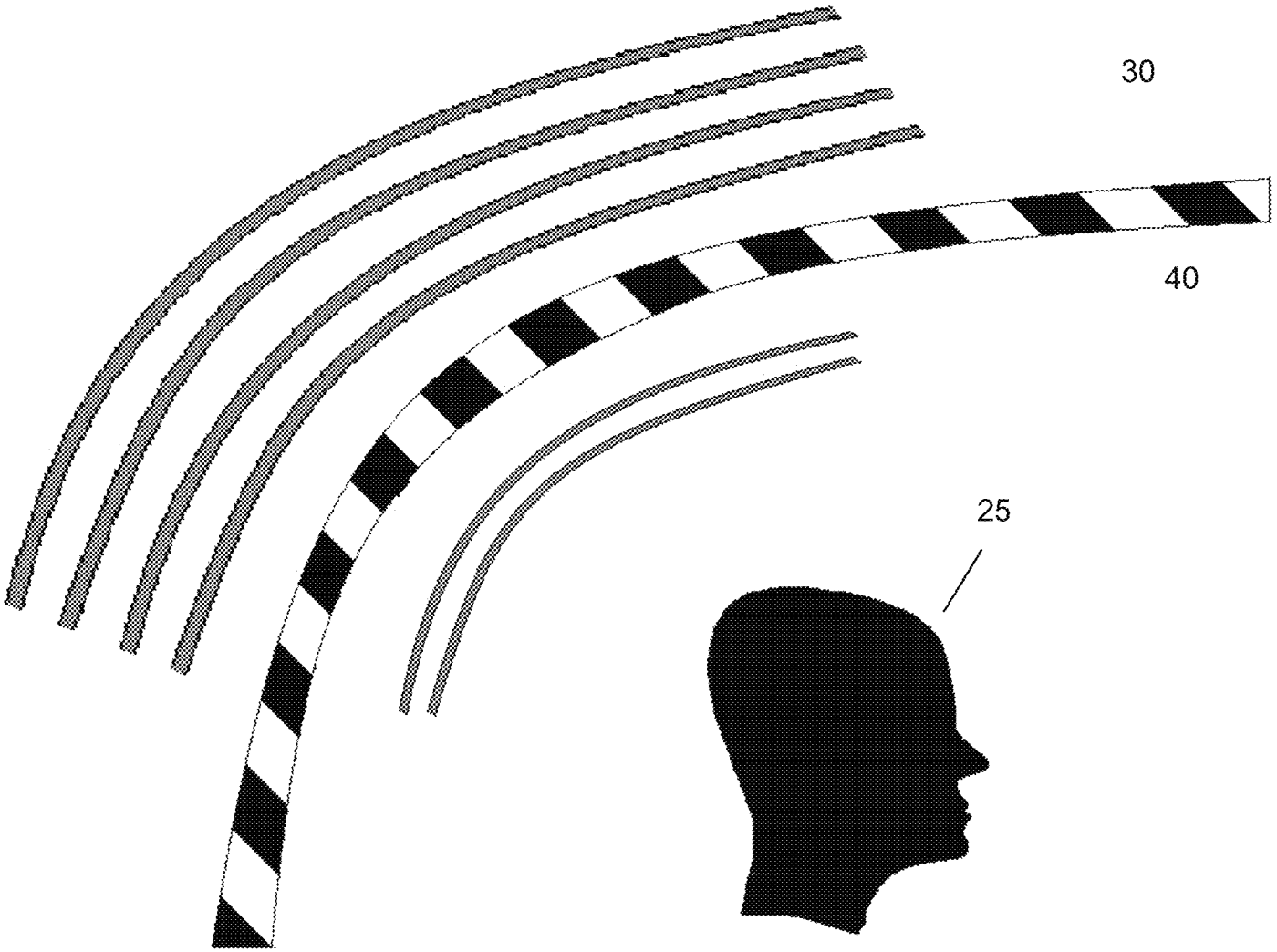
FIG. 4 is a schematic showing use of noise dampening material to dampen outside noises.

Noise in vehicles are caused by several noise sources such as, for example, wind noise, engine noise, noise caused by the tires rolling over the ground and/or squeaking and rattling of interior components of the vehicle. Passive noise suppression for in cabin systems such as in aircrafts and vehicles are known. The typical solution is to install noise dampening material (such as shown in FIG. 4).

Active noise cancellation systems for head phones are well known (see, for example, http://en.wikipedia.org/wiki/Noise-cancelling_headphones). Basically, these are based on destructive interference (or anti sound, or counter noise). Active noise (and vibration) cancellation is also in use to reduce vibration and noise generated by wind generators and airplanes. The efficiency also increases when the structural born noise becomes reduced.

Figure 5:
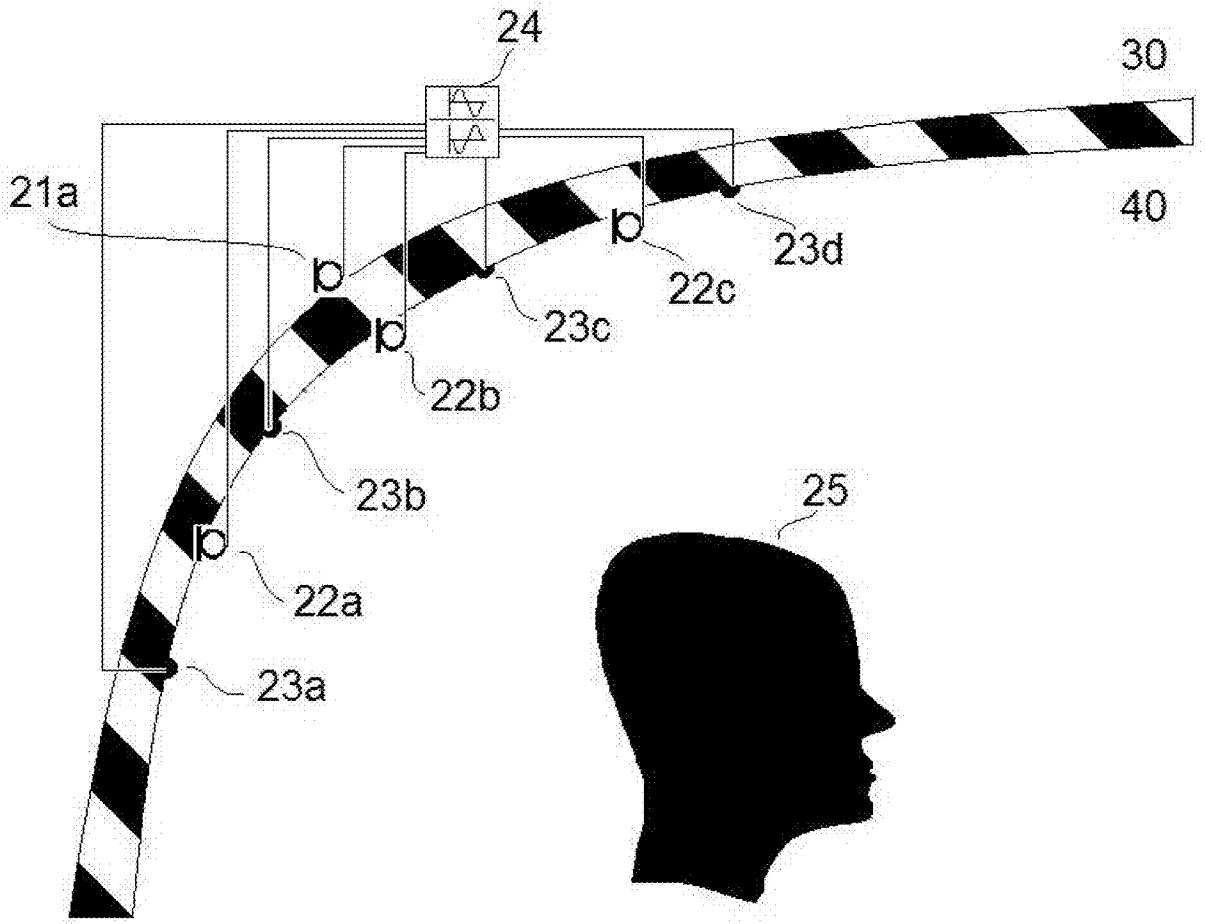
FIGS. 5 and 6 are schematics showing reduction or elimination of a sound wave intruding into the vehicle cabin from outside the cabin by counter noise emission inside the vehicle cabin.
Figure 6:
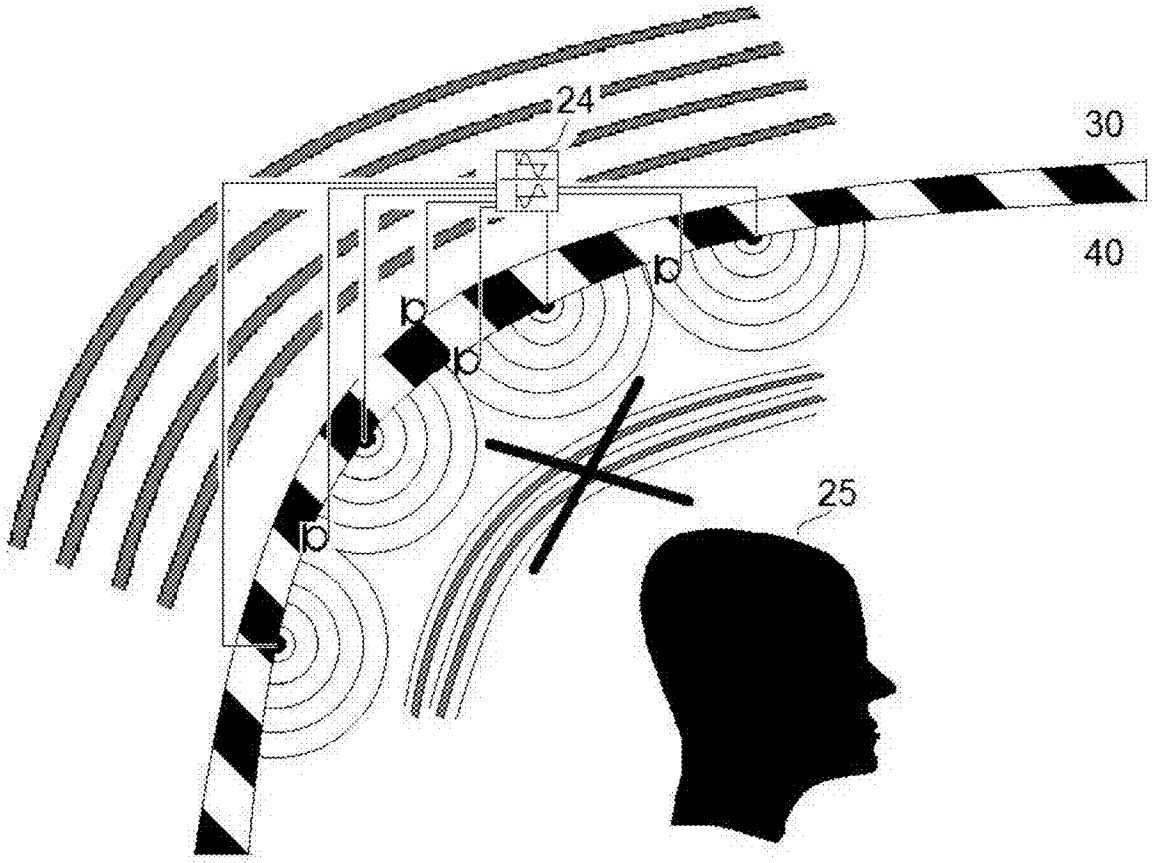

In cabin noise cancellation systems, it is also known to perform active cabin noise suppression (see, for example, http://www.autotrends.org/2012/09/28/innovative-bose-and-noise-cancellation-technology/). These systems monitor the noise inside the vehicle using microphones (or acceleration detectors) and attempt to cancel the noise by generating an identical signal that is 180 degrees out-of-phase with the detected signal. An example of such a noise cancellation system 24 is shown in FIGS. 5 and 6, showing multiple microphones 22*a-c* (and exterior microphone 21*a*) disposed in the vehicle cabin, with FIG. 6 showing the system at work, eliminating a sound wave inside intruding from outside the cabin by counter noise emission (such as via noise emitters 23*a-d*) inside the vehicle. Typically, such systems work well below 100 Hz, but higher frequencies are cancelled less effectively.

For suppressing low frequencies and reducing vibrations, it had been found useful to place microphones or acceleration detectors and sound speakers or accelerators close to the noise causing devices of the vehicle, such as the muffler system or the engine (see, for example, http://www.honda.co.nz/technology/driving/anc/ and http://www.heise.de/autos/artikel/Antischall-sorgt-fuer-neuen-Motorsound-796760.html?bild=2;view=bildergalerie). For example, the Honda Legend is equipped with an active noise cancellation system.

For generating the counter noise (180 degrees out of phase) in 3 dimensional (3D) air space, a temporary equalizing is necessary. The noise cancellation only works locally when the counter noise is generated in a way that it arrives in timely fashion to a listener's ear when the (causing) noise arrives. This is much more complicated compared to headphone noise cancellation since the 3D time and space-wise expansion of a sound wave front has to be considered (lateral run times). The group propagation time of low frequencies is lower than these of high frequencies. Sound waves leave loudspeakers concentrically, as the timely coherent wave front is concentric. The amplitude may be emitted in a coil shape, distance wise. The wave front's speed is independent from the speaker system, just from the air density and humidity (and the gases components).

Figure 2:
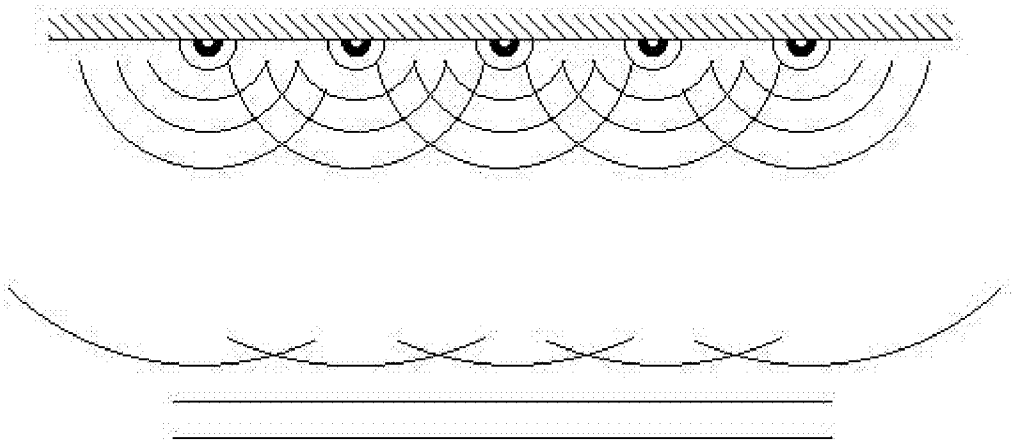
FIG. 2 is a schematic showing use of multiple loudspeakers controlled so that a generally flat wave front is generated.
Figure 3:
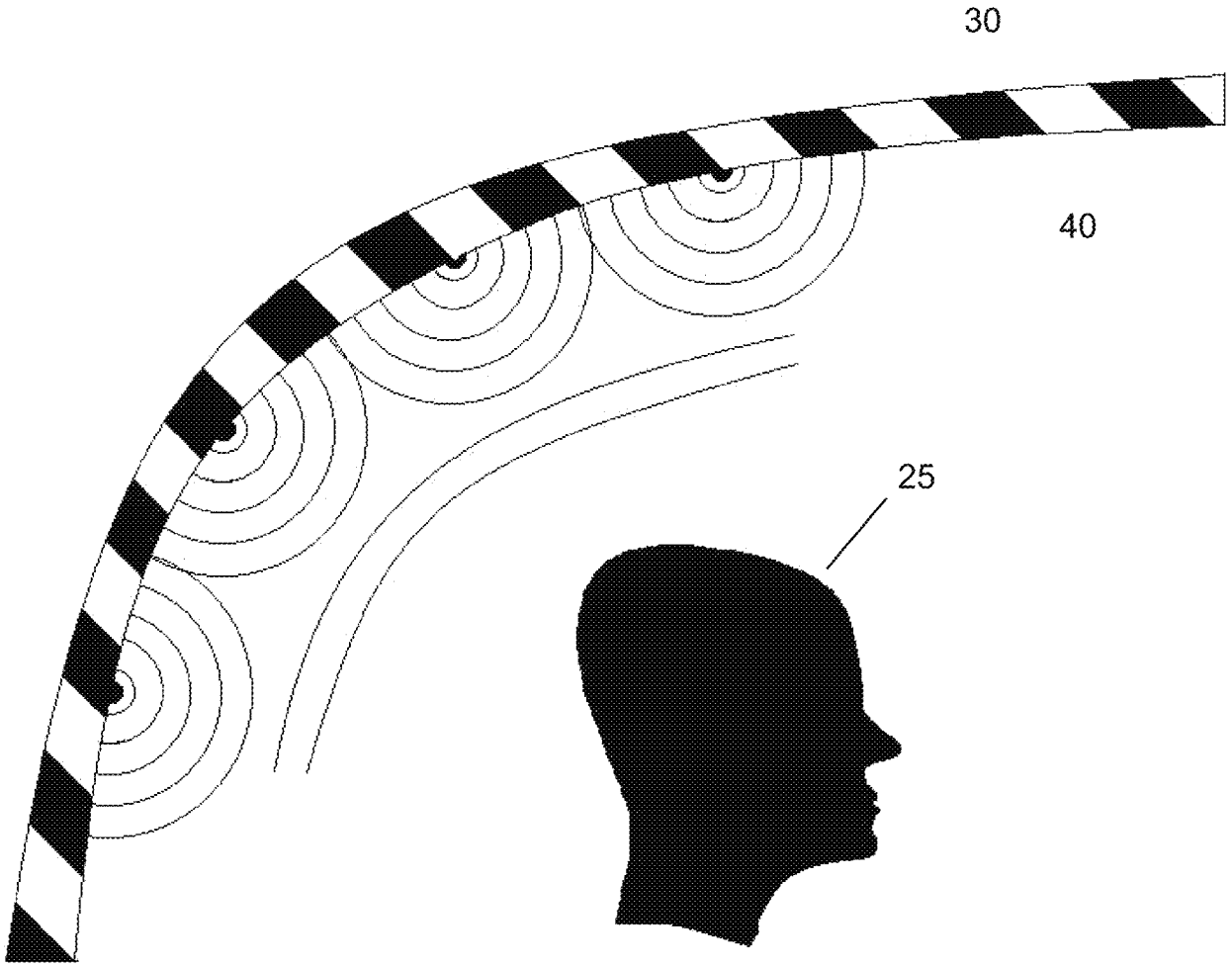
FIG. 3 is a schematic showing use of multiple loudspeakers controlled so that the wave front is a curved inward shape running toward a common center.

When using multiple loudspeakers, the single wave fronts superpose to each other. When controlled in a timely correct fashion with similar sound signals, a wave front which is less concentric but more straight forms out (according to Huygen's principle), see FIG. 2 and see, for example, http://idiap.ch/~mccowan/arrays/tutorial.pdf. When multiple speakers are in use, the wave front may be controlled in curved inward shape running to a common center, such as to be seen in FIGS. 3 and 11D.

By fine tuning of the phase timing of loudspeakers that are in different positions, the common wave front's direction can be controlled. It is known to use these properties to virtually widen the acoustic room. It sounds like a sound source would be placed beyond the cabin's borderlines (outside).

A known way of equalizing the counter noise is the use of adaptive filters, often applied on DSPs (see, for example, http://www.intechopen.com/books/adaptive-filtering-applications/applications-of-adaptive-filtering).

Reflective waves are practically too chaotic to become detected and counter generated, by that these are not eliminable and no full noise elimination is possible.

For human voice conception, the signal to noise ratio (SNR) is crucial. By that the lowering of the absolute noise level (whether by active or passive noise suppression) is beneficial to the SNR. On the other hand, the SNR can be improved when the (voice-) signal amplitude gets raised by amplification, while the noise doesn't get amplified (or is less amplified).

It is known from automotive applications to utilize spectral subtraction on single microphone systems to diminish the noise level (see, for example, http://www.ant.uni-bremen.de/sixcms/media.php/102/4975/COST_1992_simmer.pdf). It is also known from vehicle hands free smart phone applications to use a microphone with a sensitivity direction coil, directed to the position where the driver is usually located.

It is also known from vehicle hands free smart phone applications to use two microphones, one for picking up the voice plus the unavoidable noise (preferably under use of a microphone with a coil directed to the mouth) and one picking up the noise alone (reference signal) without the speech or vocal signal. The difference in both signals is the desired speech signal. It is common to use two channel adaptive filtering to filter out the speech signal with the noise subtracted.

It is also known that hearing disability aids utilize more than one microphone, or multiple microphones or a microphone array (see, for example, http://www.rehab.research.va.gov/jour/87/24/4/pdf/schwander.pdf). Also the use of coherence functions were published (http://www.ncbi.nlm.nih.gov/pmc/articles/PMC3246289/).

Several more methods have been suggested for voice separation or detection, such as blind source separation (BSS) using Independent Component Analysis (ICA) and beam forming done on microphone arrays. It has also been suggested to use a two stage BSS for speech separation with an initialization stage and an iterative estimation stage for obtaining the parameters of transfer functions between a microphone array and an voice output (such as, for example, a speech channel) of a mobile phone application for noise suppression (see, for example, http://www.nttdocomo.co.jp/english/binary/pdf/corporate/technology/rd/technical_journal/bn/vol9_4/vol9_4_031en.pdf).

Untypical in automotive applications, such as hands free telephoning, voice vehicle commanding, is to have microphones or microphone arrays not only for picking up the driver's voice but to also have microphones or microphone arrays to capture the voices of the other passengers of a vehicle.

The present invention provides a system that utilizes both active noise cancellation techniques and human voice conception/separation techniques to provide an enhanced sound system for an automobile cabin. The system of the present invention may utilize microphones and speakers and sound processing or digital sound processing techniques, such as by utilizing aspects of the systems described in U.S. Pat.

Nos. 7,657,052; 6,420,975; 6,278,377 and/or 6,243,003, which are hereby incorporated herein by reference in their entireties The system of the present invention may use at least one and preferably more microphones (in suitable distances to one another) disposed at respective seats of the vehicle and with a sensitivity coil for each vehicle passenger, directed towards the passengers accordingly or to have microphone arrays under use of beam forming methods directing the beam to the according passengers (voices). The system may, responsive to signals of or from the microphones representative of the received voices, amplify that according passenger's voice (the speaking occupant's voice) to get emitted by loudspeakers near the other occupied vehicle seats and directed to the other passenger's heads or virtually placing the amplified speakers voice near to the real position, or virtually behind the passenger or virtually close to his or her displayed image as discussed below. This may be done while not using the speakers at or near the speaking occupant's seat so that those speakers do not emit the amplified voice of the speaking occupant. The system may incorporate or combine an active noise cancelation system or music entertainment system or music entertainment system.

Figure 7:
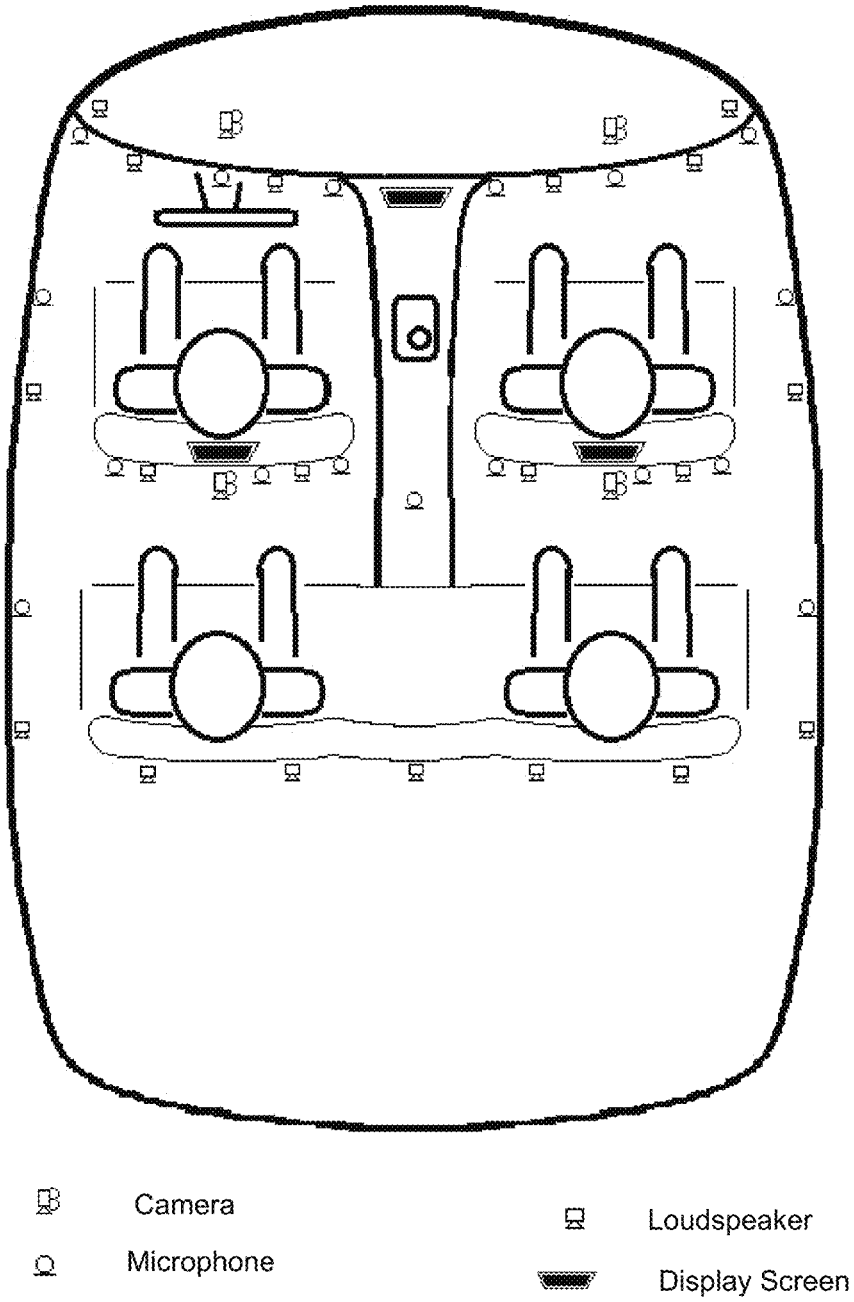
FIG. 7 is a plan view of a vehicle cabin having multiple microphones and speakers disposed in the vehicle cabin in accordance with the present invention.
Figure 8:
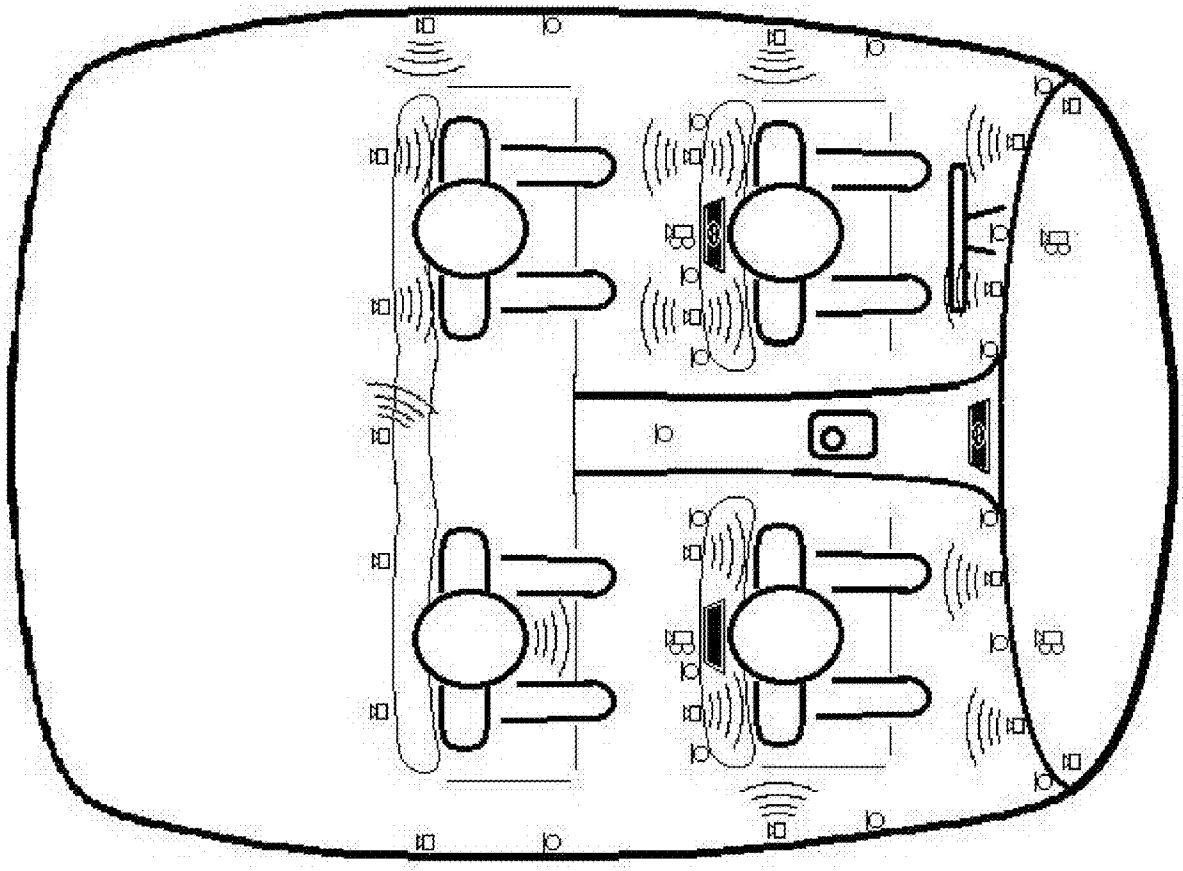
FIG. 8 is a plan view similar to FIG. 7, showing operation of the system when the passenger in the rear right seat speaks.
Figure 8:
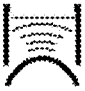
Figure 8:
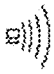
Figure 8:
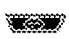

FIG. 7 shows an example of such a setup (the inside of a vehicle cabin) in accordance with the present invention. Several microphones are placed around the respective driver and passenger seats. FIG. 7 is in 2D, showing the passengers from overtop. The microphones and loudspeakers may be on the same plane or generally at the same height or may be at several different heights. FIG. 8 shows such a system at work. In FIG. 8, the passenger at the rear right seat speaks, and his or her voice gets captured by the microphones at different distances nearby (at or near the respective rear right seat of the vehicle) and the captured vocal signal is amplified and replicated through the loudspeakers near the other seats and other passengers.

Optionally, the system may activate and use loudspeakers at only those seats that are currently occupied by a driver or passenger (such as by being at least in part responsive to an interior cabin monitoring system or seat occupant detector system or the like, such as by utilizing aspects of the monitoring or detecting systems described in U.S. Pat. Nos. 8,258,932; 6,485,081; 6,166,625 and/or 5,877,897, which are hereby incorporated herein by reference in their entireties). In such a configuration, the speakers of occupied seats would be used to generate sound outputs while the speakers of non-occupied seats would not be used to generate sound outputs. Optionally, responsive to such a seat occupancy determination, the microphones and speakers at determined unoccupied seats may be turned off or not used by the system to reduce processing.

Optionally, the system may activate and use selected microphones and loudspeakers only at selected seats that have been selected by a user of the system (such as the driver or one of the passengers of the vehicle actuating a user input to select particular occupants/seats for a conversation), whereby the speaker's voice (if the speaker is one of the selected occupants) will be output to others of the selected seats and occupants, while not being output to non-selected seats and occupants. Thus, for example, and with reference to FIG. 8, if the driver and the rear right seat occupant want to have a conversation, the system may only use the microphones and loudspeakers at or near those two seats, such that, when the rear right seat occupant speaks, only the microphones at or near the rear right seat capture the voice signals and only the speakers at or near the driver seat are actuated to output the speaker's voice. The loud speakers at or near the other (non-selected) seats do not output the speaker's voice and optionally may be used to cancel noise and the voice signals of the speaking occupant (at the rear right seat in the above example) and the sound output of the loudspeakers of the selected other occupant (the driver in the above example) so that the other occupants may not readily hear and understand the conversation between the selected occupants. Optionally, the other speakers at the non-selected seats/occupants may output music or other sound playback to further limit or preclude the non-selected occupants from hearing the conversation of the selected occupants. The user input may comprise any suitable input device that may be operable by the driver or passenger or may comprise several input devices with an input device or button or switch at each seat or display screen that allows the occupant at that seat to enter the conversation (i.e., become a selected occupant) or exit the conversation (i.e., become a non-selected occupant).

Thus, the system of the present invention allows for selected users or seat occupants to carry on a conversation while non-selected users or occupants are effectively kept out of the conversation. The system of the present invention also provides for video display of images of the speaking person (as discussed below) and may display such video only at a display screen or screens that is/are viewable by the selected users. The system thus provides enhanced communication between occupants in a vehicle and provides for selective communication between only those occupants that are selected to be part of the communication.

Optionally, one or more display devices may be disposed in the vehicle (such as shown in FIG. 8) and may display images (such as images captured by one or more cameras in the vehicle having respective fields of view that encompasses the head region of an occupant of each seat of the vehicle) of the head or mouth region of all cabin occupants or just the speaking person or persons on one or multiple displays. As shown in FIG. 8, the displays in the front and rear left show the head of the speaking passenger at the rear right. Persons with hearing disabilities may particularly benefit from such a system, since they may be able to read the lips of the speaking person while the person that is speaking even though that person may not be in the line of sight normally since this person may sit in different row of the vehicle. Optionally, a more sophisticated system may dedicate the spoken text of a person by known art speech to voice detection and display it below the displayed head of the speaking person or may display just the text putting the dedicated speakers name in front of his spoken text (by that displaying the chat inside the vehicle in text). Optionally, that chat's text may be recordable by the system. The cameras and displays may be activated and used by the system only for seats that have been determined to be occupied and/or only for seats/occupants that have been selected for a conversation.

Optionally, the system may have a mute function to suppress one or more or all passengers' voices and music on the drivers or other passenger's request (such as pushing a mute button). The mute function may be done by stopping the voice amplification and music playback or instead may actively suppress other speakers' voices sound by actively emitting noise eliminating counter noise at the specific (listening) person's head area, similar to the active suppression of ambient noise. Such a function may be beneficial for a stressed parent, trying to concentrate on driving while the children are yelling or for passengers who may want to sleep while other passenger may speak or listen to music. Optionally, there may be different music or film soundtrack playback at every seat, by actively eliminating the incoming sound from the sound sources of other seats at each specific seat.

Figure 11A:
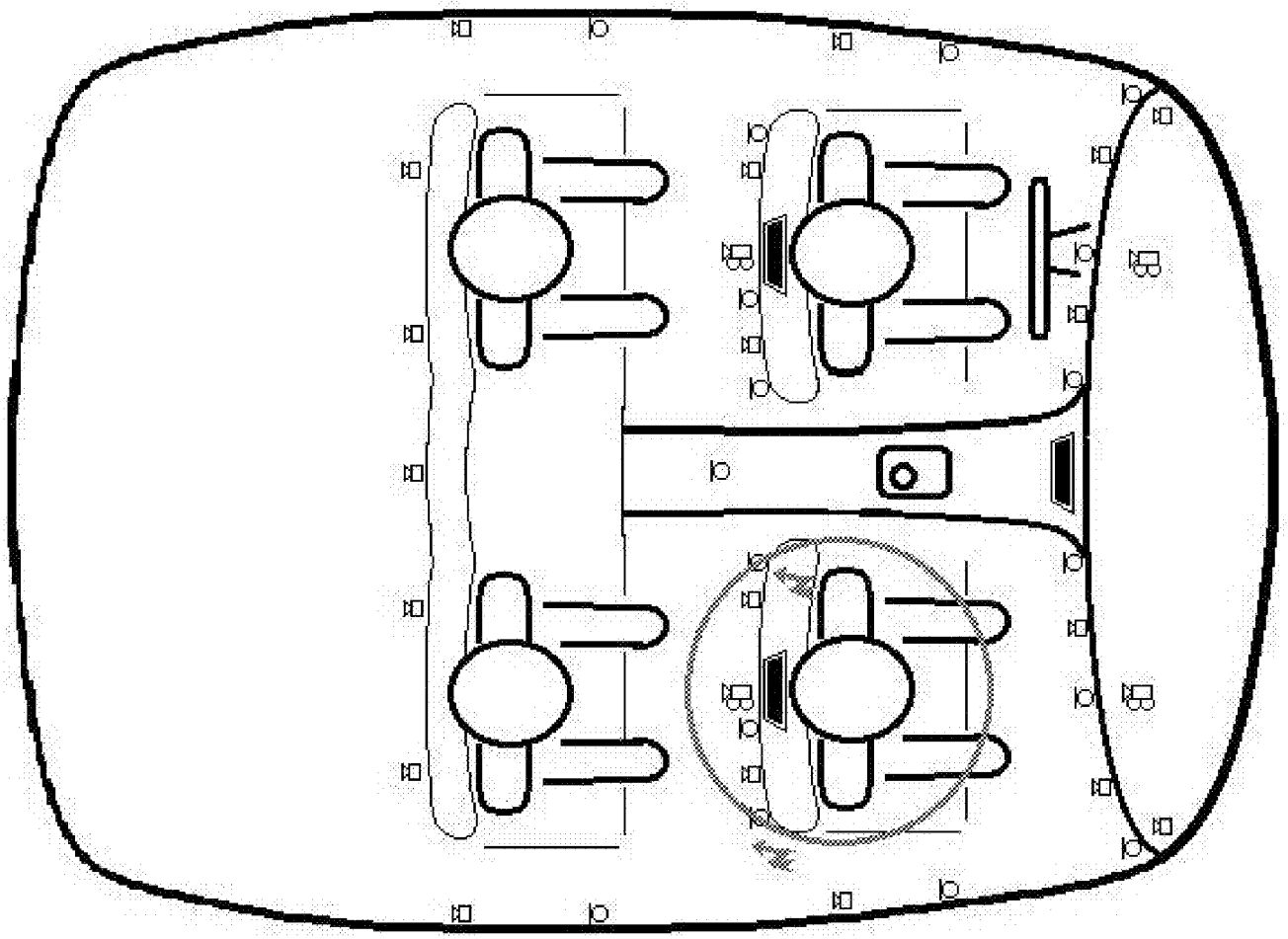
FIGS. 11A-D are plan views of an interior cabin of a vehicle with multiple microphones and speakers, showing time steps of the sound waves after a person in the vehicle speaks.
Figure 11B:
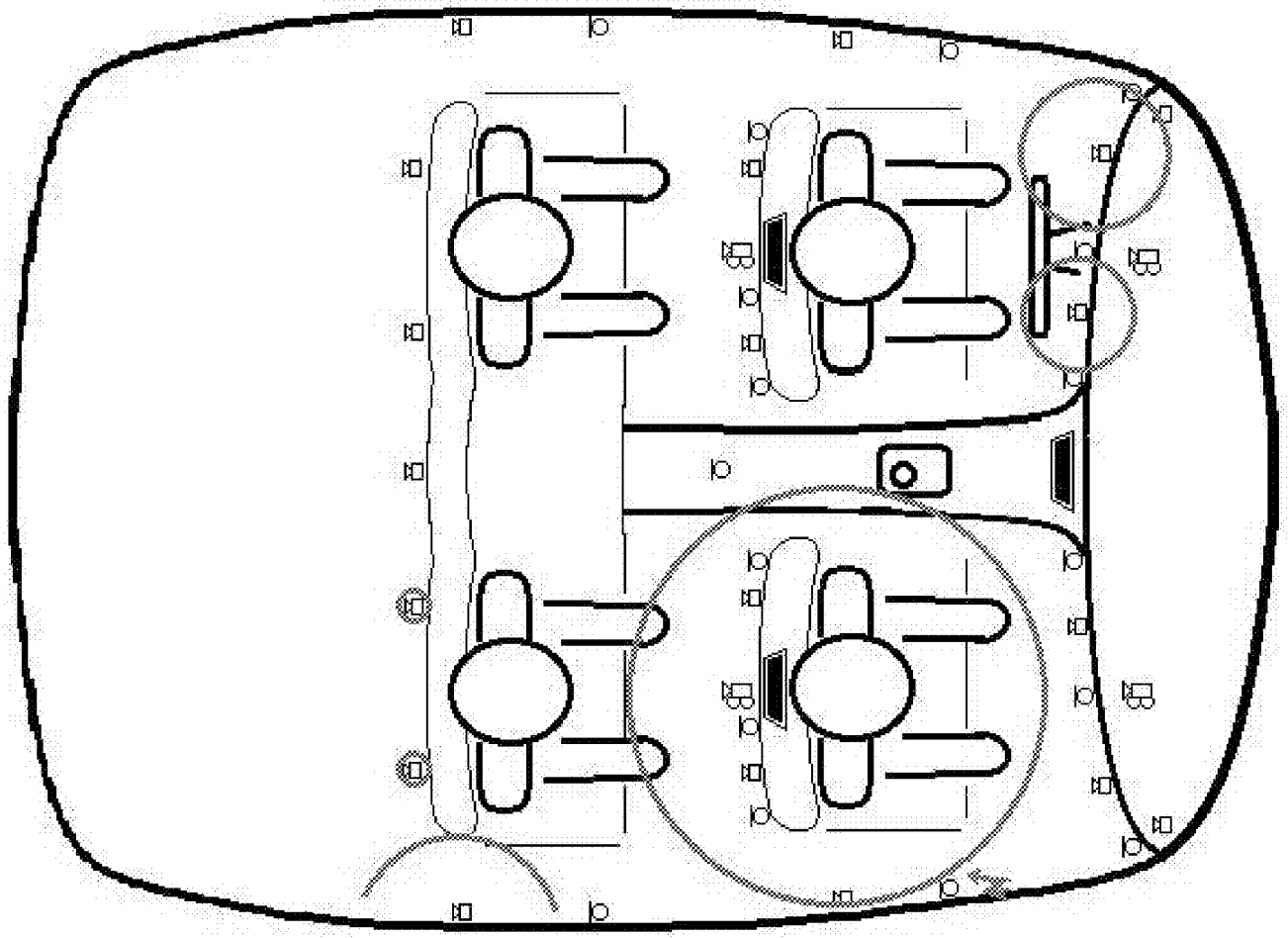
Figure 11C:
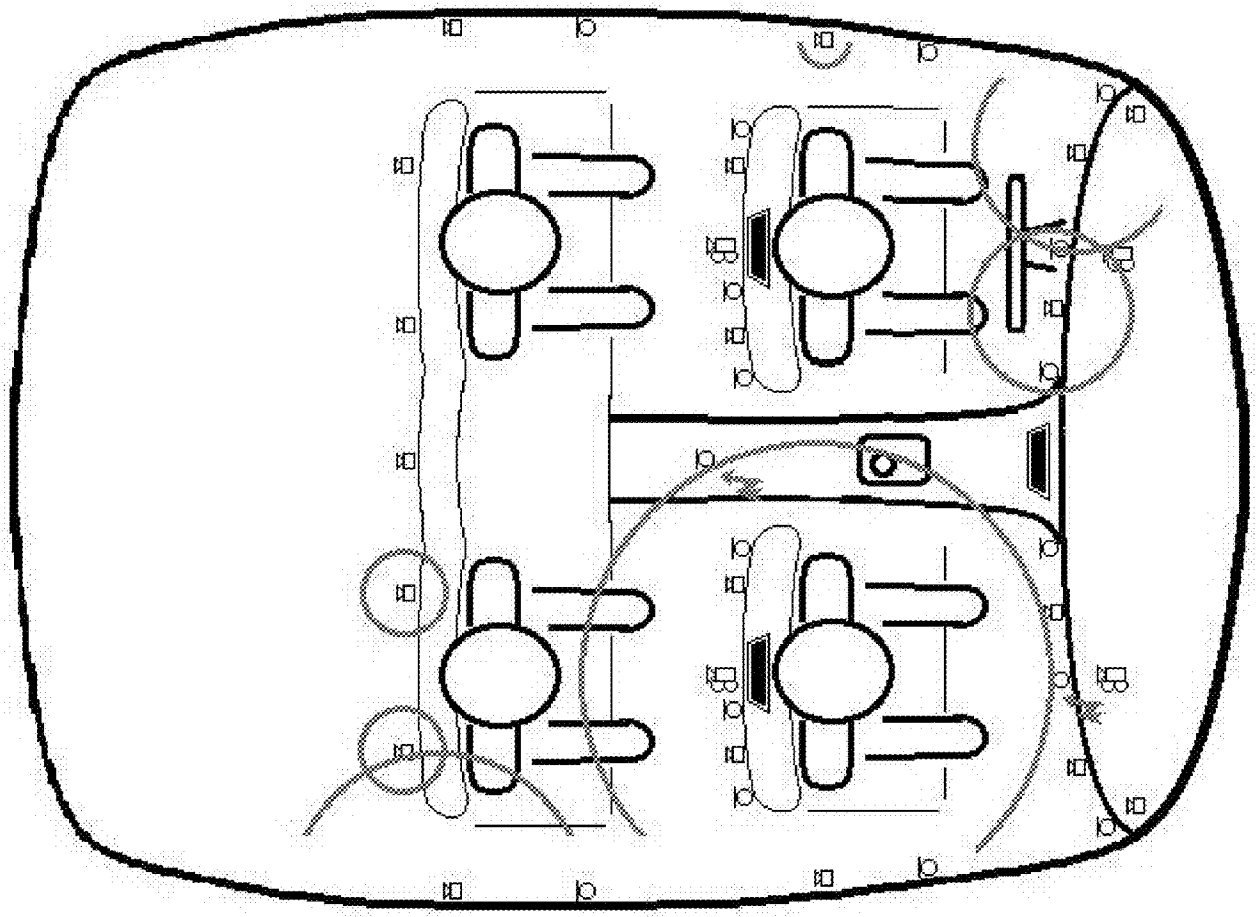
Figure 11D:
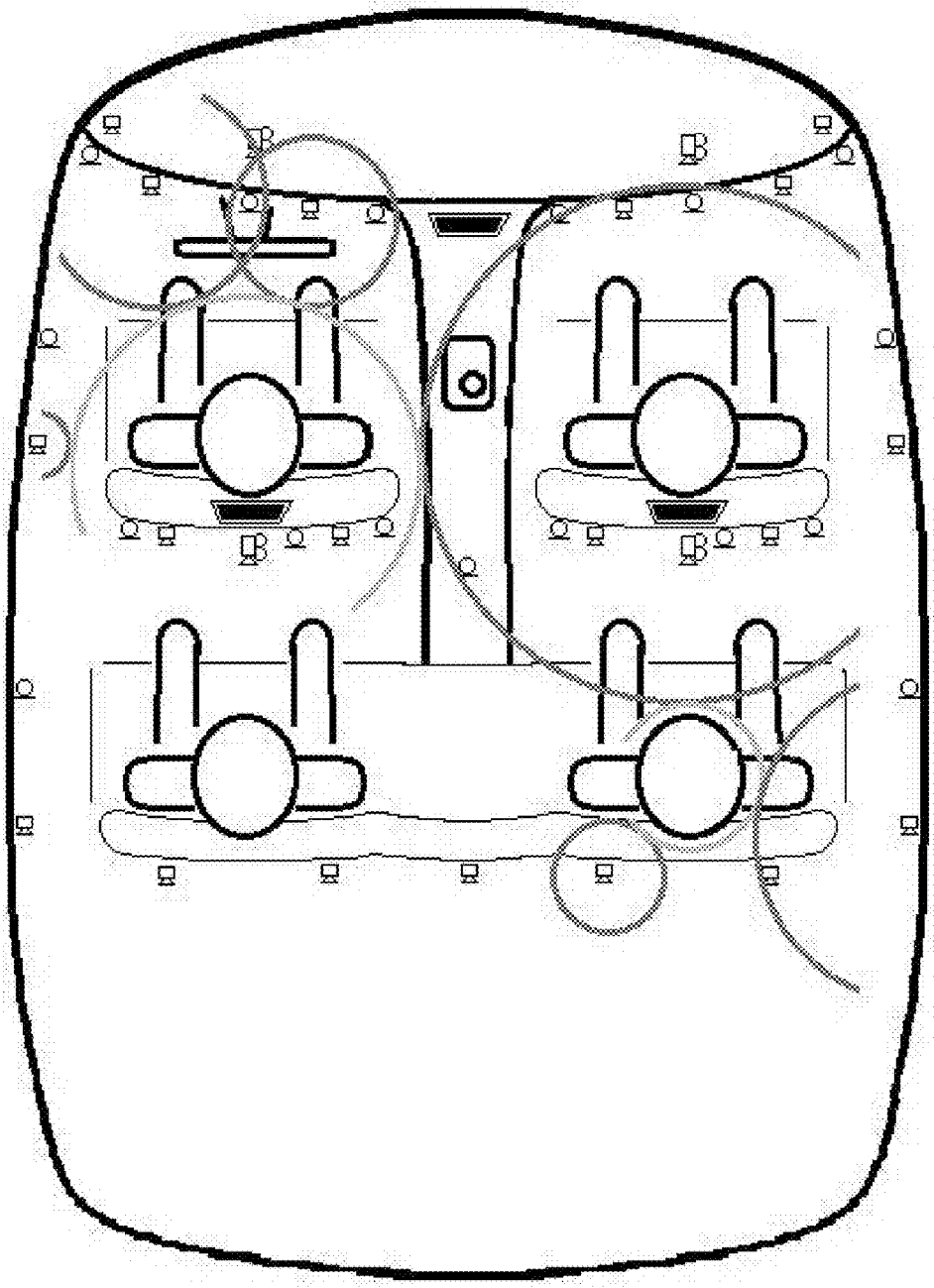

When a person speaks, the person's voice sound waves depart evenly in all directions (assuming that there is no additional (substantial) air flow) at essentially the same speed (depending on the air density, humidity and gas composition, the sound wave propagation time may vary and typically higher frequency sound waves' propagation times are slightly less than those of lower frequency sound waves), by that the voice signal expands through the (air-) space away from the speakers mouth concentrically (such as like as a bubble shape). In FIGS. 11A-D, a simplified visualization of the voice propagation in time and space is shown. An exemplary time-wise point of the speech of a speaking passenger in the right front seat is picked out and its time and space wise propagating voice signal wave front visualized as gray circle (instead of a bubble, since it's a 2D top view to the in cabin of a passenger vehicle). Reflection waves on the car interior, car roof top, side and bottom aren't reflected in this visualization for clarity purposes. These may be present as well in reality and may by partially incorporated to the sound processing of the system. FIG. 11A shows the point of time at which the wave front is captured by the first microphones, indicated by the lightning bolts. A small time step later is shown in FIG. 11B. Loudspeakers near other passengers have played back the sound signals captured by the microphones which may have been analyzed, superimposed with other microphones' signals, noise filtered, noise reduced and controlled in time and phase. The loudspeakers playback sound propagation wave front is shown as essentially equidistant to the incoming original sound wave front propagating away from the speaker's mouth. In a later point of time these wave fronts have further expanded as shown in FIG. 11C. In FIG. 11D, which shows a time step later compared to the time step in FIG. 11C, light gray circles symbolize the developing combined sound wave (according to Huygen's principle) concentrically collapsing towards the listener's head (-box), combined from the speaker's original voice signal and the signals from the loud speakers.

In this visualization, the sound wave's phase is not visualizable. By controlling the point of time and phase of each sound wave, the cognitive direction of the sound source can be controlled, as well the eventually wanted elimination of sound (such as shown in FIG. 6), and the voice signals can be controlled.

Optional microphones (such as microphones 21*a-d* in FIGS. 1 and 5) outside 30 the cabin (inside 40 in FIGS. 4-6) may capture the ambient noise outside of the cabin and microphones 22*a-c* in FIG. 5 inside the cabin may capture voices (the to-be-used signal) and passively dampen noise from outside (the to-be-eliminated signal) for feeding to the noise cancellation system 24 (FIG. 6), which may use the inside and outside noise signal differences to separate the noise signal. The in cabin ambient noise may be actively cancelled by subtractive counter noise playback and a passenger's or several passengers' speech signals may be improved by active noise suppression on these (captured) speech channels.

Optionally, there may be a couple of microphones or an array of microphones installed for better filtering the voice of a specific speaker from the ambient noise under use of known art voice separation and beam forming methods as discussed above.

Figure 9:
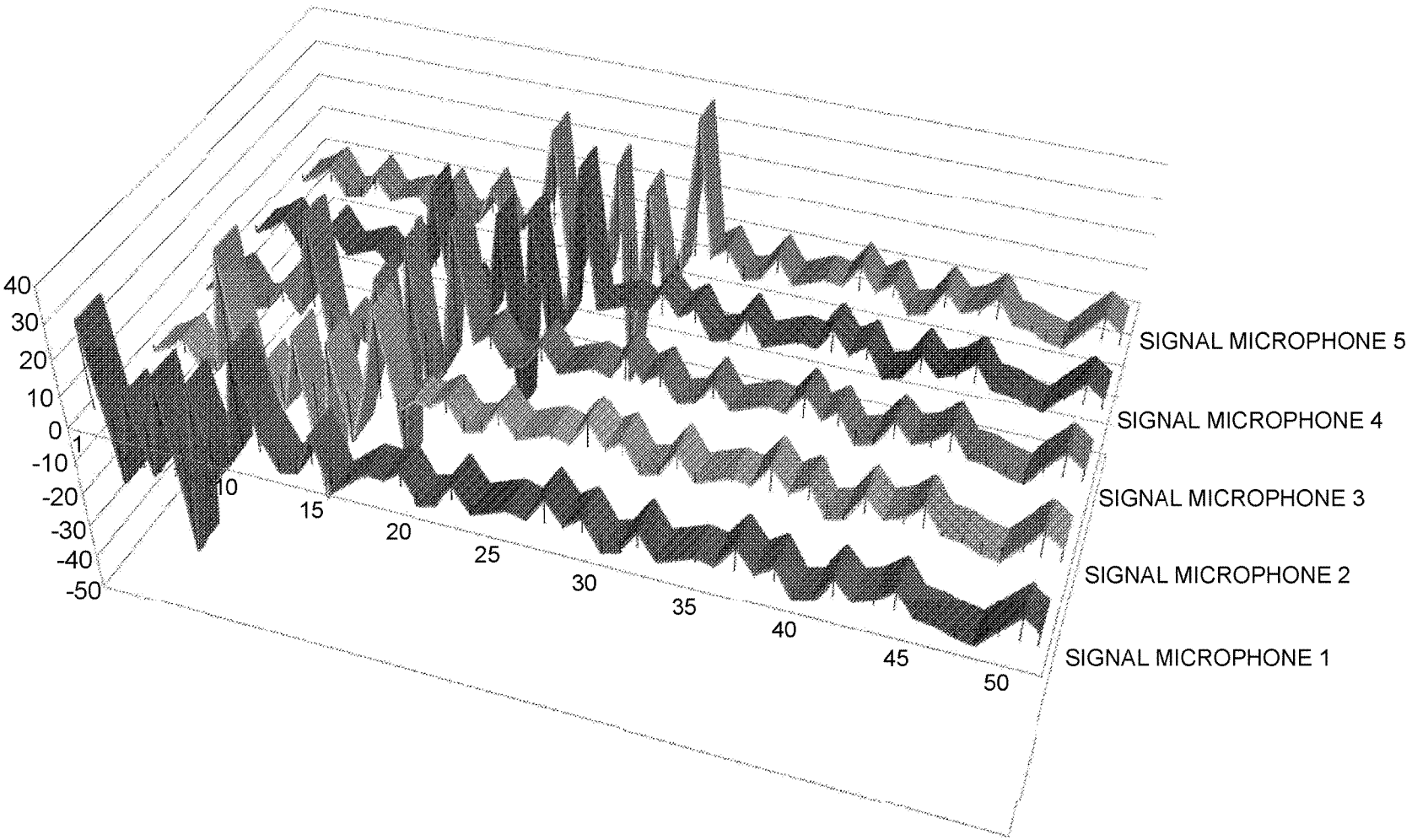
FIGS. 9 and 10 are graphs showing superposing the signals of different microphones which are different distances from a speaker.
Figure 10:
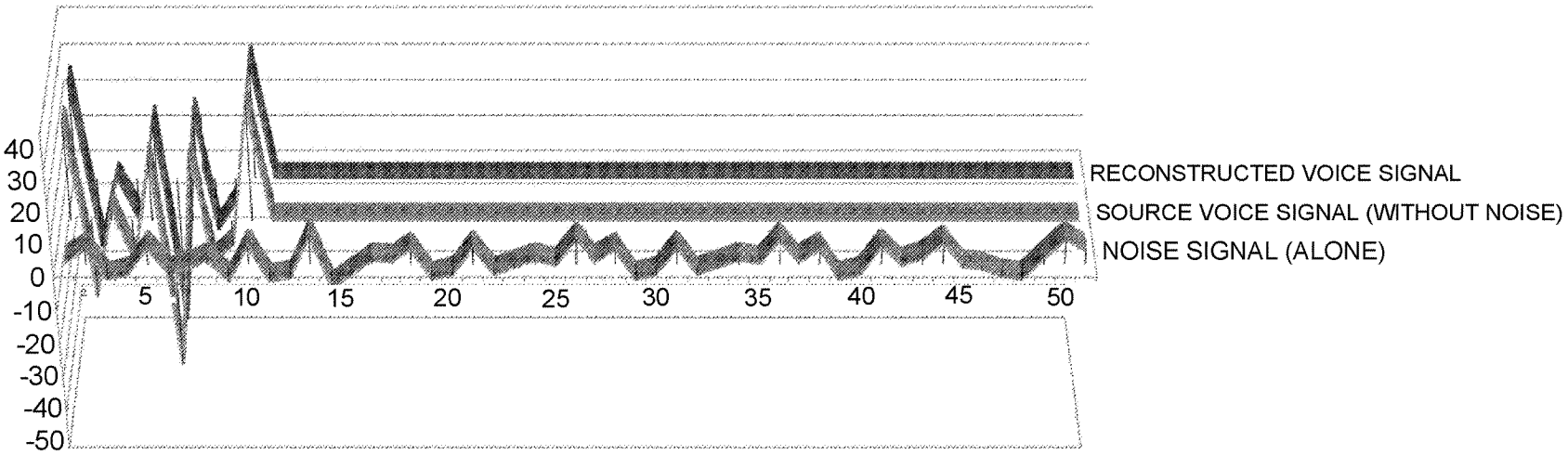

The filtering of voice signals from ambient noise by lateral delay can be done by superposing the signals of different microphones which are in different distances to a speaker from one another. Since the ambient noise is always different at different points in time and the voice signal is always similar, the noise evens out and the SNR increases by that. This is visualized in the examples shown in FIGS. 9 and 10.

Optionally, such a system may use a head tracking system (such as described in U.S. patent application Ser. No. 14/675,929, filed Apr. 1, 2015 and published Oct. 15, 2015 as U.S. Publication No. US-2015-0296135, which is hereby incorporated herein by reference in its entirety) or a vehicle surveillance system (such as described in U.S. patent application Ser. No. 14/675,926, filed Apr. 1, 2015 and published Oct. 15, 2015 as U.S. Publication No. US-2015-0294169, which is hereby incorporated herein by reference in its entirety), which may track each passenger's head position. By that, the lateral sound filtering may be tuned more exactly to specifically capture the voice of a specific speaker and leave out the ambient noise. Optionally, the voice filtering system may be used as another sensor for the head tracking system or may be incorporated into the head tracking system. The signal may be sufficient for dedicating a speaker's head box while speaking.

The voice amplification may be chosen dynamically depending on the ambient in cabin noise level.

The system may actively suppress audio back coupling to suppress echoing and howling such as experienced from megaphones by known algorithms.

The system may lower the amplifications of the microphones close to the other passengers while one passenger is speaking to lower the ambient noise amplification and back coupling.

Optionally, the system may additionally have microphones 21 installed outside of the vehicle 10 (see FIG. 1) to detect desired sound from outside the vehicle. The exterior microphones may detect sounds which are not blocked from the driver crucial to the orientation within the traffic, such as signal horns (such as, for example, from an emergency vehicle). Optionally, the specific sound source may be analyzed and detected as crucial (such as, for example, by clustering, using an Adaboost for instance) by the sound suppressing (in this case not suppressing, but amplifying) system to get played back inside the cabin. The analysis may be done in selectively reduced sound wave bands in which plausible sound signals of crucial sound sources may be found and those may be filtered. Optionally, specific sound sequences may be filtered out between the noise by specific known wave form compare and detect algorithms to be considered as crucial or not. Optionally, the playback of outside crucial sound sources may be just done for the driver seat or head box. Optionally, the source of the crucial sound (such as an ambulance siren) such as an ambulance vehicle gets captured by vehicle cameras such as cameras of a forward vision system or surround view vision system (such as exterior viewing cameras 14*a*, 14*b*, 14*c*, 14*d* in FIG. 1) or rear view vision system with rearward directed side cameras or blind spot image detecting system (such as by utilizing aspects of the vision systems described in International Publication No. WO 2014/204794, which is hereby incorporated herein by reference in its entirety) and a control employed to bring the specific camera's captured image with the crucial sound source to the display screen (that is disposed in the cabin and viewable by the driver of the vehicle). Optionally, the view provided may be an artificially assembled view such as a top view, panorama view, partially augmented view or fully augmented view.

The sound playback of the determined sound source of interest or crucial sound source may be amplified during all other playbacks, or voice amplifications may be diminished or switched off. The playback of the crucial sound source may be virtually set into that direction and/or distance the sound source is in reality (for example, if an ambulance is ahead of the equipped vehicle and in a left lane approaching the vehicle, the speakers at the left front region of the cabin may be used to output the sound or other speakers may be used in a manner that makes the sound appear to emanate from the left front region of the cabin). Optionally, the crucial sound source's real position may be transmitted by a car2car or a car2X system, for artificially simulating the sound source (and its position), which may not be in hearing range already or barely hearable within the noise outside.

The vehicle vision system and/or driver assist system and/or object detection system that may also be used in conjunction with the voice acquisition or sound system of the present invention may operate to capture images exterior of the vehicle and may process the captured image data to display images and to detect objects at or near the vehicle and in the predicted path of the vehicle, such as to assist a driver of the vehicle in maneuvering the vehicle in a rearward direction. The vision system includes an image processor or image processing system that is operable to receive image data from one or more cameras and provide an output to a display device for displaying images representative of the captured image data. Optionally, the vision system may provide a top down or bird's eye or surround view display and may provide a displayed image that is representative of the subject vehicle, and optionally with the displayed image being customized to at least partially correspond to the actual subject vehicle.

Figure 1:
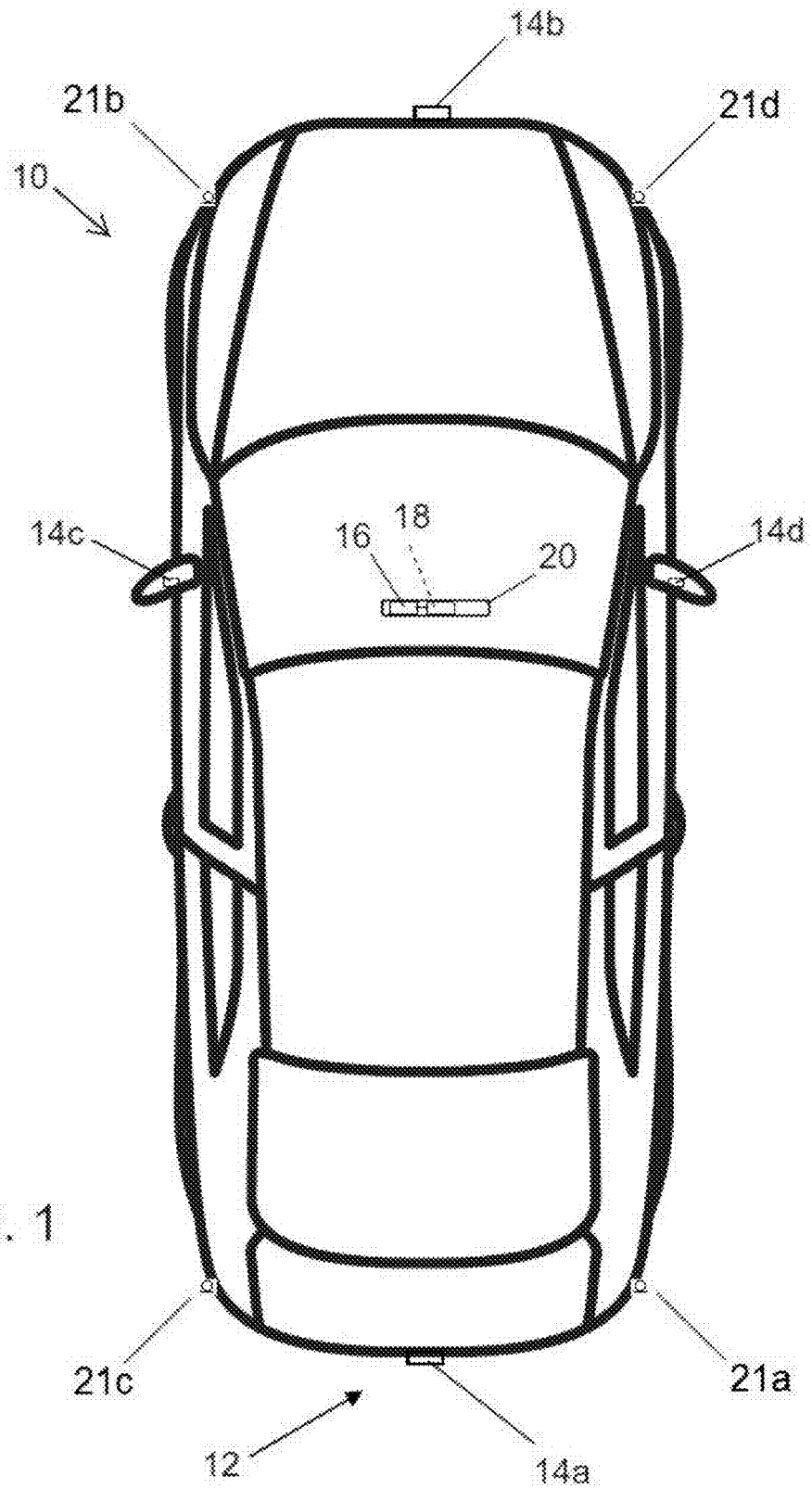
FIG. 1 is a plan view of a vehicle with a sound system that incorporates microphones at an exterior of the vehicle.

As shown in FIG. 1, the vehicle 10 includes an imaging system or vision system 12 that includes at least one exterior facing imaging sensor or camera, such as a rearward facing imaging sensor or camera 14*a* (and the system may optionally include multiple exterior facing imaging sensors or cameras, such as a forwardly facing camera 14*b* at the front (or at the windshield) of the vehicle, and a sidewardly/rearwardly facing camera 14*c*, 14*d* at respective sides of the vehicle), which captures images exterior of the vehicle, with the camera having a lens for focusing images at or onto an imaging array or imaging plane or imager of the camera. The vision system 12 includes a control or electronic control unit (ECU) or processor 18 that is operable to process image data captured by the cameras and may provide displayed images at a display device 16 for viewing by the driver of the vehicle (although shown in FIG. 1 as being part of or incorporated in or at an interior rearview mirror assembly 20 of the vehicle, the control and/or the display device may be disposed elsewhere at or in the vehicle). The data transfer or signal communication from the camera to the ECU may comprise any suitable data or communication link, such as a vehicle network bus or the like of the equipped vehicle.

The system includes an image processor operable to process image data captured by the camera or cameras, such as for detecting objects or other vehicles or pedestrians or the like in the field of view of one or more of the cameras. For example, the image processor may comprise an EyeQ2 or EyeQ3 image processing chip available from Mobileye Vision Technologies Ltd. of Jerusalem, Israel, and may include object detection software (such as the types described in U.S. Pat. Nos. 7,855,755; 7,720,580 and/or 7,038,577, which are hereby incorporated herein by reference in their entireties), and may analyze image data to detect vehicles and/or other objects. Responsive to such image processing, and when an object or other vehicle is detected, the system may generate an alert to the driver of the vehicle and/or may generate an overlay at the displayed image to highlight or enhance display of the detected object or vehicle, in order to enhance the driver's awareness of the detected object or vehicle or hazardous condition during a driving maneuver of the equipped vehicle.

The vehicle may include any type of sensor or sensors, such as imaging sensors or radar sensors or lidar sensors or ladar sensors or ultrasonic sensors or the like. The imaging sensor or camera may capture image data for image processing and may comprise any suitable camera or sensing device, such as, for example, a two dimensional array of a plurality of photosensor elements arranged in at least 640 columns and 480 rows (at least a 640×480 imaging array, such as a megapixel imaging array or the like), with a respective lens focusing images onto respective portions of the array. The photosensor array may comprise a plurality of photosensor elements arranged in a photosensor array having rows and columns. Preferably, the imaging array has at least 300,000 photosensor elements or pixels, more preferably at least 500,000 photosensor elements or pixels and more preferably at least 1 million photosensor elements or pixels. The imaging array may capture color image data, such as via spectral filtering at the array, such as via an RGB (red, green and blue) filter or via a red/red complement filter or such as via an RCC (red, clear, clear) filter or the like. The logic and control circuit of the imaging sensor may function in any known manner, and the image processing and algorithmic processing may comprise any suitable means for processing the images and/or image data.

The camera or cameras may comprise any suitable cameras or imaging sensors or camera modules, and may utilize aspects of the cameras or sensors described in U.S. Publication No. US-2009-0244361 and/or U.S. Pat. Nos. 8,542,451; 7,965,336 and/or 7,480,149, which are hereby incorporated herein by reference in their entireties. The imaging array sensor may comprise any suitable sensor, and may utilize various imaging sensors or imaging array sensors or cameras or the like, such as a CMOS imaging array sensor, a CCD sensor or other sensors or the like, such as the types described in U.S. Pat. Nos. 5,550,677; 5,670,935; 5,760,962; 5,715,093; 5,877,897; 6,922,292; 6,757,109; 6,717,610; 6,590,719; 6,201,642; 6,498,620; 5,796,094; 6,097,023; 6,320,176; 6,559,435; 6,831,261; 6,806,452; 6,396,397; 6,822,563; 6,946,978; 7,339,149; 7,038,577; 7,004,606; 7,720,580 and/or 7,965,336, and/or International Publication Nos. WO/2009/036176 and/or WO/2009/046268, which are all hereby incorporated herein by reference in their entireties.

Optionally, the vision system may include a display for displaying images captured by one or more of the imaging sensors for viewing by the driver of the vehicle while the driver is normally operating the vehicle. Optionally, for example, the vision system may include a video display device disposed at or in the interior rearview mirror assembly of the vehicle, such as by utilizing aspects of the video mirror display systems described in U.S. Pat. No. 6,690,268 and/or U.S. Publication No. US-2012-0162427, which are hereby incorporated herein by reference in their entireties. The video mirror display may comprise any suitable devices and systems and optionally may utilize aspects of the compass display systems described in U.S. Pat. Nos. 7,370,983; 7,329,013; 7,308,341; 7,289,037; 7,249,860; 7,004,593; 4,546,551; 5,699,044; 4,953,305; 5,576,687; 5,632, 092; 5,677,851; 5,708,410; 5,737,226; 5,802,727; 5,878,370; 6,087,953; 6,173,508; 6,222,460; 6,513,252 and/or 6,642,851, and/or European patent application, published Oct. 11, 2000 under Publication No. EP 0 1043566, and/or U.S. Publication No. US-2006-0061008, which are all hereby incorporated herein by reference in their entireties.

Optionally, the vision system (utilizing the forward facing camera and a rearward facing camera and other cameras disposed at the vehicle with exterior fields of view) may be part of or may provide a display of a top-down view or birds-eye view system of the vehicle or a surround view at the vehicle, such as by utilizing aspects of the vision systems described in International Publication Nos. WO 2010/099416; WO 2011/028686; WO 2012/075250; WO 2013/019795; WO 2012/075250; WO 2012/145822; WO 2013/081985; WO 2013/086249 and/or WO 2013/109869, and/or U.S. Publication No. US-2012-0162427, which are hereby incorporated herein by reference in their entireties.

Optionally, the display or displays and any associated user inputs may be associated with various accessories or systems, such as, for example, a tire pressure monitoring system or a passenger air bag status or a garage door opening system or a telematics system or any other accessory or system of the mirror assembly or of the vehicle or of an accessory module or console of the vehicle, such as an accessory module or console of the types described in U.S. Pat. Nos. 7,289,037; 6,877,888; 6,824,281; 6,690,268; 6,672,744; 6,386,742 and/or 6,124,886, and/or U.S. Publication No. US-2006-0050018, which are hereby incorporated herein by reference in their entireties.

Changes and modifications in the specifically described embodiments can be carried out without departing from the principles of the invention, which is intended to be limited only by the scope of the appended claims, as interpreted according to the principles of patent law including the doctrine of equivalents.

The invention claimed is:

1. A sound system for a vehicle, said sound system comprising:

a plurality of microphones disposed at an exterior of a vehicle equipped with said sound system, wherein said microphones detect sounds emanating from outside of the vehicle;

a sound processor operable to process microphone output signals of said microphones to identify a source of at least some sounds detected by said microphones;

a plurality of cameras disposed at the equipped vehicle and having respective exterior fields of view, said plurality of cameras including at least a front camera disposed at a front portion of the equipped vehicle and viewing at least forward of the equipped vehicle, a left side camera disposed at a left side portion of the equipped vehicle and viewing at least sideward of the equipped vehicle, a right side camera disposed at a right side portion of the equipped vehicle and viewing at least sideward of the equipped vehicle, and a rear camera disposed at a rear portion of the equipped vehicle and viewing at least rearward of the equipped vehicle;

a video display disposed in the equipped vehicle and viewable by a driver of the equipped vehicle, wherein said video display displays images derived from image data captured by at least some of said plurality of cameras;

a plurality of speakers disposed in the cabin of the equipped vehicle, wherein said speakers generate sound responsive to said sound processor;

wherein said sound processor processes microphone output signals to identify a sound of interest outside of the vehicle;

wherein the sound of interest comprises a siren of an emergency vehicle;

wherein, responsive to identification by said sound processor of the sound of interest, said speakers generate sound representative of the identified sound of interest;

wherein at least one camera of said plurality of cameras captures image data representative of the emergency vehicle;

an electronic control unit comprising a data processor, wherein image data captured by said plurality of cameras is processed at said electronic control unit for identifying the emergency vehicle;

wherein, while said speakers are generating sound representative of the identified sound of interest, sounds generated by said speakers based on audio signals from other sound systems in the vehicle are diminished;

wherein, when said speakers generate sound representative of the identified sound of interest, the sound representative of the identified sound of interest is directed principally towards the driver of the equipped vehicle and is not directed principally toward any other occupant of the equipped vehicle; and wherein images derived from image data captured by the at least one camera that is representative of the emergency vehicle are displayed at said video display for viewing by the driver of the equipped vehicle.

2. The sound system of claim 1, wherein said sound processor controls said speakers to generate the sound representative of the identified sound of interest while not generating other sounds present in the microphone output signals of said microphones.

3. The sound system of claim 1, wherein a location of the vehicle that is the source of the identified sound of interest is transmitted by the source vehicle and received by said sound system via a wireless car to car communication system.

4. The sound system of claim 1, wherein said sound processor controls said speakers so that the sound representative of the sound of interest is heard by the driver of the equipped vehicle as if emanating from a direction towards the source of the sound of interest.

5. The sound system of claim 4, wherein the direction towards the source of the sound of interest is determined by said sound processor processing the microphone output signals of said microphones.

6. The sound system of claim 4, wherein the direction towards the source of the sound of interest is determined, at least in part, by processing of image data captured by the at least one camera of said plurality of cameras disposed at the equipped vehicle.

7. The sound system of claim 6, wherein, responsive to determination of presence of the source of the emergency vehicle in the field of view of the at least one camera, said video display displays images representative of the source of the sound of interest for viewing by the driver of the equipped vehicle.

8. The sound system of claim 6, wherein said plurality of cameras are part of a surround view vision system of the equipped vehicle.

9. The sound system of claim 4, wherein the direction towards the source of the sound of interest is determined at least in part by a wireless communication from a transmitter remote from the equipped vehicle.

10. The sound system of claim 9, wherein the transmitter is part of a vehicle to vehicle communication system or a vehicle to infrastructure communication system.

11. The sound system of claim 1, wherein the sound of interest outside of the vehicle is identified by said sound processor at least in part via a wireless communication from a transmitter remote from the equipped vehicle.

12. The sound system of claim 11, wherein the transmitter is part of a vehicle to vehicle communication system or a vehicle to infrastructure communication system.

13. The sound system of claim 1, wherein said sound processor reduces noise in the processor output signal responsive to said exterior microphones.

14. The sound system of claim 13, wherein said sound processor reduces noise in the processor output signal via an active noise cancellation technique.

15. A sound system for a vehicle, said sound system comprising:

a plurality of microphones disposed at an exterior of a vehicle equipped with said sound system, wherein said microphones detect sounds emanating from outside of the vehicle;

a sound processor operable to process microphone output signals of said microphones to identify a source of at least some sounds detected by said microphones;

a plurality of cameras disposed at the equipped vehicle and having respective exterior fields of view, said plurality of cameras including at least a front camera disposed at a front portion of the equipped vehicle and viewing at least forward of the equipped vehicle, a left side camera disposed at a left side portion of the equipped vehicle and viewing at least sideward of the equipped vehicle, a right side camera disposed at a right side portion of the equipped vehicle and viewing at least sideward of the equipped vehicle, and a rear camera disposed at a rear portion of the equipped vehicle and viewing at least rearward of the equipped vehicle;

a video display disposed in the equipped vehicle and viewable by a driver of the equipped vehicle, wherein said video display displays images derived from image data captured by at least some of said plurality of cameras;

a plurality of speakers disposed in the cabin of the equipped vehicle, wherein said speakers generate sound responsive to said sound processor;

wherein said sound processor processes microphone output signals to identify a sound of interest outside of the vehicle;

wherein the sound of interest comprises a siren of an emergency vehicle;

wherein, responsive to identification by said sound processor of the sound of interest, said speakers generate sound representative of the identified sound of interest;

wherein said sound processor controls said speakers to generate the sound representative of the identified sound of interest while not generating other sounds present in the microphone output signals of said microphones;

wherein at least one camera of said plurality of cameras captures image data representative of the emergency vehicle;

an electronic control unit comprising a data processor, wherein image data captured by said plurality of cameras is processed at said electronic control unit for identifying the emergency vehicle;

wherein, when said speakers generate sound representative of the identified sound of interest, the sound representative of the identified sound of interest is directed principally towards a driver of the equipped vehicle and is not directed principally toward any other occupant of the equipped vehicle;

wherein said sound processor controls said speakers so that the sound representative of the sound of interest is heard by the driver of the equipped vehicle as if emanating from a direction towards the source of the sound of interest;

wherein, while said speakers are generating sound representative of the identified sound of interest, sounds generated by said speakers based on audio signals from other sound systems in the vehicle are diminished; and wherein images derived from image data captured by the at least one camera that is representative of the emergency vehicle are displayed at said video display for viewing by the driver of the equipped vehicle.

16. The sound system of claim 15, wherein the direction towards the source of the sound of interest is determined by said sound processor processing the microphone output signals of said microphones.

17. The sound system of claim 15, wherein the direction towards the source of the sound of interest is determined, at least in part, by image processing of image data captured by the at least one camera, and wherein said plurality of cameras are part of a surround view vision system of the equipped vehicle.

18. The sound system of claim 15, wherein the direction towards the source of the sound of interest is determined at least in part by a wireless communication from a transmitter remote from the equipped vehicle.

19. A sound system for a vehicle, said sound system comprising:

a plurality of microphones disposed at an exterior of a vehicle equipped with said sound system, wherein said microphones detect sounds emanating from outside of the vehicle;

a sound processor operable to process microphone output signals of said microphones to identify a source of at least some sounds detected by said microphones;

a plurality of cameras disposed at the equipped vehicle and having respective exterior fields of view, said plurality of cameras including at least a front camera disposed at a front portion of the equipped vehicle and viewing at least forward of the equipped vehicle, a left side camera disposed at a left side portion of the equipped vehicle and viewing at least sideward of the equipped vehicle, a right side camera disposed at a right side portion of the equipped vehicle and viewing at least sideward of the equipped vehicle, and a rear camera disposed at a rear portion of the equipped vehicle and viewing at least rearward of the equipped vehicle;

a video display disposed in the equipped vehicle and viewable by a driver of the equipped vehicle, wherein said video display displays images derived from image data captured by at least some of said plurality of cameras;

a plurality of speakers disposed in the cabin of the equipped vehicle, wherein said speakers generate sound responsive to said sound processor;

wherein said sound processor processes microphone output signals to identify a sound of interest outside of the vehicle;

wherein the sound of interest comprises a siren of an emergency vehicle;

wherein, responsive to identification by said sound processor of the sound of interest, said speakers generate sound representative of the identified sound of interest;

wherein at least one camera of said plurality of cameras captures image data representative of the emergency vehicle;

an electronic control unit comprising a data processor, wherein image data captured by said plurality of cameras is processed at said electronic control unit for identifying the emergency vehicle present in the field of view of the at least one camera;

wherein, when said speakers generate sound representative of the identified sound of interest, said sound processor controls said speakers to generate sound representative of the sound of interest principally towards a driver of the equipped vehicle and is not directed principally toward any other occupant of the equipped vehicle;

wherein said sound processor controls said speakers so that the sound representative of the sound of interest is heard by the driver of the equipped vehicle as if emanating from a direction towards the source of the sound of interest;

wherein the direction towards the source of the sound of interest is determined by one of (i) said sound processor processing the microphone output signals of said microphones, (ii) image processing of image data captured by the at least one camera of said plurality of cameras disposed at the equipped vehicle, and (iii) a wireless communication from a transmitter remote from the equipped vehicle; and wherein, while said speakers are generating sound representative of the identified sound of interest, sounds generated by said speakers based on audio signals from other sound systems in the vehicle are diminished; and wherein images derived from image data captured by the at least one camera that is representative of the emergency vehicle are displayed at said video display for viewing by the driver of the equipped vehicle.

20. The sound system of claim 19, wherein the sound of interest outside of the vehicle is identified by said sound processor at least in part via the wireless communication from the transmitter remote from the equipped vehicle, and wherein the transmitter is part of a vehicle to vehicle communication system or a vehicle to infrastructure communication system.

* * * * *